US006679310B2

(12) United States Patent
De Zen

(10) Patent No.: US 6,679,310 B2
(45) Date of Patent: Jan. 20, 2004

(54) PANELS FOR OVERHEAD FOLDING DOOR AND THEIR ARTICULATING CONNECTIONS

(75) Inventor: Vic De Zen, Woodbridge (CA)

(73) Assignee: Royal Group Technologies Limited, Woodbridge (CA)

( * ) Notice: Subject to any disclaimer, the term of this patent is extended or adjusted under 35 U.S.C. 154(b) by 71 days.

(21) Appl. No.: 10/167,971

(22) Filed: Jun. 13, 2002

(65) Prior Publication Data

US 2003/0000656 A1 Jan. 2, 2003

(30) Foreign Application Priority Data

Jun. 29, 2001 (CA) ..... 2351945

(51) Int. Cl.[7] ..... E06B 3/48
(52) U.S. Cl. ..... 160/229.1; 160/236
(58) Field of Search ..... 160/201, 236, 160/40, 229.1, 232, 235; 49/501

(56) References Cited

U.S. PATENT DOCUMENTS 4,884,316 A * 12/1989 Masuda ..... 16/288
5,857,510 A * 1/1999 Krupke et al.
5,909,762 A * 6/1999 Denoual et al.
5,934,352 A * 8/1999 Morgan
6,328,091 B1 * 12/2001 Whitley
6,363,993 B1 * 4/2002 Aquilina

* cited by examiner

*Primary Examiner*—Blair M. Johnson

(57) ABSTRACT

For overhead folding doors which are molded from plastic, the panels have a front wall formed at its upper edge in a slightly recessed arcuate tenon and providing at the bottom a recessed area behind a bottom edge. The panels are adapted to be hingedly connected with the bottom edge of an upper panel following a path in close proximity to the tenon of a lower panel to provide a pinch proof hinging arrangement.

15 Claims, 4 Drawing Sheets

19
15
17
15
19
18
19
16
24
19
16
1
19
18
15
24
1
16

PANELS FOR OVERHEAD FOLDING DOOR AND THEIR ARTICULATING CONNECTIONS

FIELD OF THE INVENTION

This invention relates to overhead sectional folding doors and, more particularly, to door panels and their articulating connections for use in overhead folding garage doors and the like.

BACKGROUND OF THE INVENTION

An overhead sectional folding door typically found, for example, in garage doors comprises a plurality of panels or sections which are hinged together to articulate about horizontal axis so that the door can be moved through the articulation of the panels as guided by suitable rollers engaging in trackways on opposite sides of the door frame from a closed vertical orientation with the panels vertically aligned to a raised generally horizontal orientation with the panels generally horizontally aligned.

Such panels may be made, for example, of wood, metal, which may simply be a metal skin on a support frame, or plastic.

Many of these doors are relatively expensive and are subject to weathering as, for example, with wood and metal doors. Also many of the doors are subject to damage even under modest impact.

Furthermore, many of the prior art doors are costly to manufacture, have excessive weight, have hinge wear problems, and are dangerous from the standpoint of fingers being caught between the panel edges as they articulate.

As many garages are beneath living quarters of the home or building, it is desirable that the closed garage door provide proper insulation both overall and at the juncture of the meeting hinge panels. At present, such insulation even in the best of overhead doors is not fully effective.

It is therefore the object of this invention to overcome the problems of the prior art and to provide extremely rugged low cost door panels adapted for reliable articulating connection in a folding overhead door.

It is another object to provide door panels formed for articulating connection utilizing readily available low cost conventional hinges.

Again, it is an object to provide panels enabling the assembly of a low cost fully insulated overhead door in which the joint between adjoining panels when the door is closed is perfectly sealed against moisture and airflow ingress or egress.

Again, it is an object to provide articulating connections between door panels which affords complete protection against pinching of fingers.

These and other objects of the invention will become apparent from the following description of the invention.

SUMMARY OF THE INVENTION

One aspect of the invention resides in providing extremely rugged low cost door panels formed for accurate articulating connection with adjoining, i.e. upper and lower, panels. In its preferred form, the panels are molded as a single member from composite plastic material. In its preferred form, each of the panels has a front wall and side walls, the front wall having an upper edge portion which is slightly retracted from the front surface of the front wall to provide a shoulder having a depth substantially equal to the thickness of the front wall. From this shoulder, the upper edge is arched upwardly and rearwardly forming an upwardly projecting part circular tongue or tenon adapted to be received in a socket or mortise area of an upper panel. The side walls of the panel extend to a point spaced about the bottom edge of the front wall a distance substantially equal to the height of the tongue or tenon formed by the panel upper edge portion whereby the space behind the bottom of the front wall defines a tongue or tenon accepting space or mortise.

According to a preferred form of the invention, the front wall is reinforced with a reinforcing formation comprising an integral gridwork of intersecting ribs formed on its rear side extending from a point adjacent the panel upper edge to adjacent the lower end of the side walls.

In another aspect of the preferred form of the invention with the part circular tenon of a lower panel received in the mortis of an upper panel immediately thereabove, the panels are articulatedly connected by hinges having the axes of their pintles lying on an axis coinciding with the centre circumscribed by the part circular lower panel tenon whereby on articulation of the upper and lower panels the lower edge of the upper panel follows in close proximity to the surface of the lower panel tenon to prevent fingers from getting pinched between the panel edges.

In another aspect according to a preferred form of the invention, the panels are provided with a rearwardly extending shelf immediately beneath the upper end of its tongue or tenon. This shelf projects rearwardly of the tenon to provide an anvil surface behind the tenon and a compressible bead of insulation material is supported on this anvil surface to be compressed thereagainst by a bottom wall connecting the side walls of the panel immediately thereabove when the panels are articulated into vertical alignment.

Again, in another aspect according to a preferred form of the invention, each of the panels is provided with one retaining slot immediately beneath the anvil surface and another retaining slot immediately above the bottom wall connecting its side walls. These slots are provided for the insertion of stiffening members or insulation retaining brackets.

In still another aspect according to a preferred form of the invention, the front wall of each of the panels is provided at its rear with fastener holding pods to receive fasteners for securing the straps of hinges to the panels, the pods being positioned to locate the pintles of the hinges as discussed above.

Again, according to still another preferred aspect of the invention, reinforcing metal straps are mounted between the hinge straps and the fastener receiving pods.

Again according to another preferred aspect of the invention, the edges of the panels are reinforced by metal channels which block finger entry into the ends of the hinged connections.

BRIEF DESCRIPTION OF THE DRAWINGS

These and other features of the invention will become apparent from the following detailed description taken in conjunction with the accompanying drawings in which.

DETAILED DESCRIPTION ACCORDING TO THE PREFERRED EMBODIMENTS OF THE PRESENT INVENTION

Figure 1:
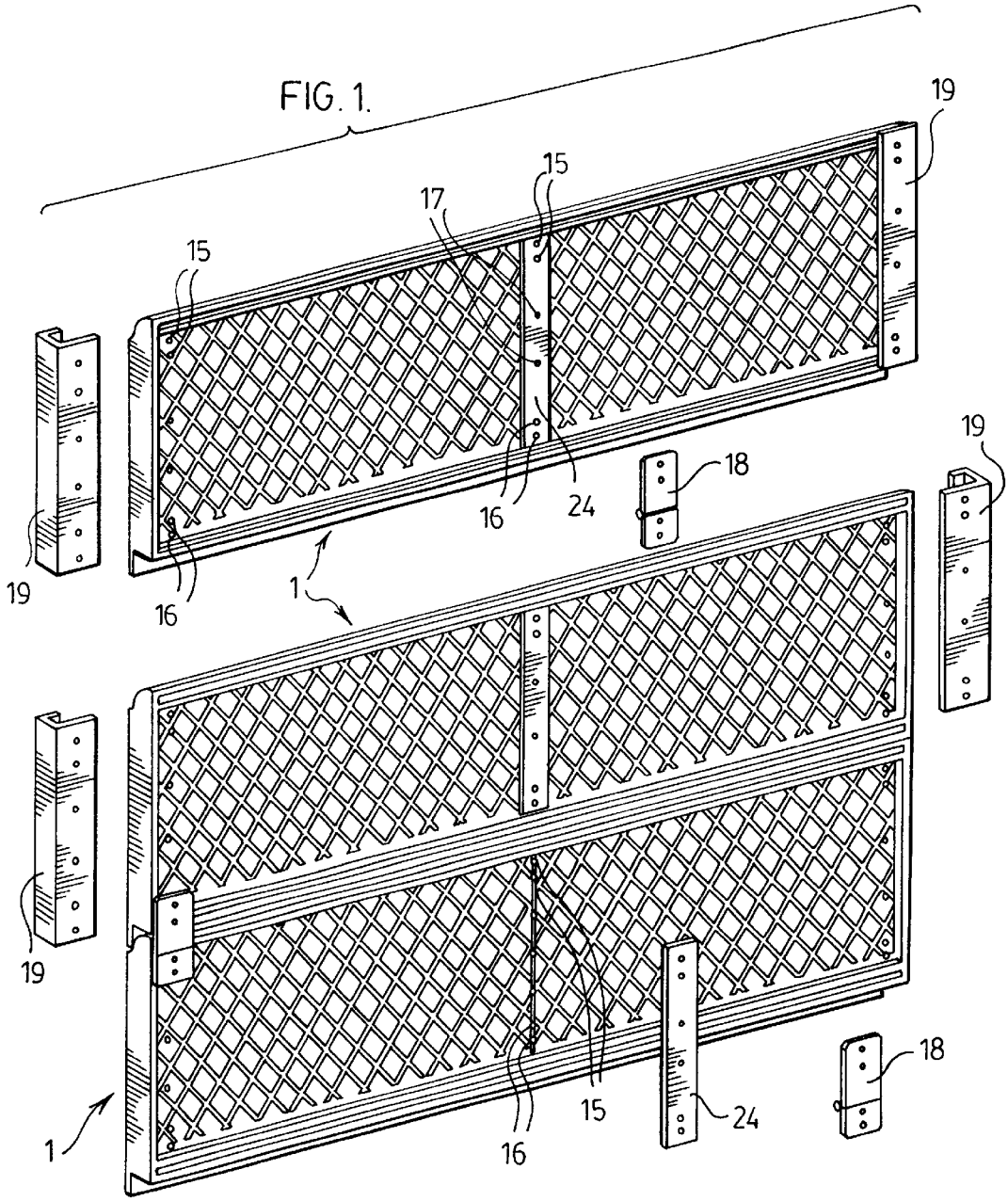
FIG. 1 is a partially exploded perspective view of the rear of two lower panels arranged in vertical alignment ready to be hingedly connected and an upper separated top panel with some of the hinges and reinforcing metal members in position ready for attachment.

With reference to FIG. 1, there are shown three panels 1 for use in an overhead folding door such as an overhead folding garage door. The two lower panels are shown arranged in vertical alignment ready to be hinged together. The upper panel is shown spaced above the two lower panels ready to be assembled with the two lower panels and hingedly connected thereto.

Figure 2:
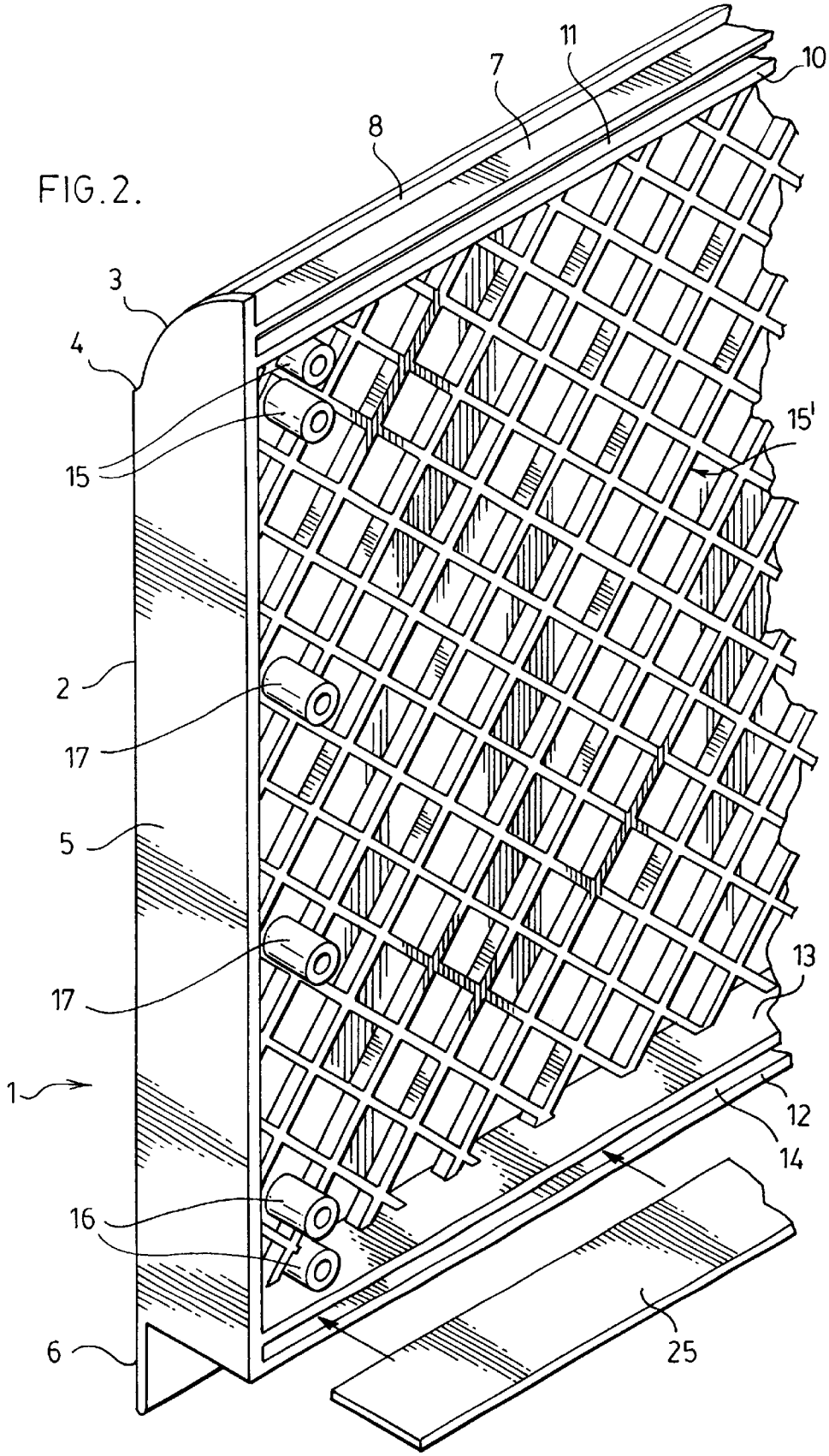
FIG. 2 is a broken away perspective view taken from the rear of one of the panels showing its construction.

Each of the panels is a molded structure molded from a composite plastic material and, as shown in FIG. 2, comprises a front wall 2, the upper edge of which curves upwardly and rearwardly in the form of a part circular knee portion 3 which constitutes a tongue or tenon in the articulating action of the panels as hereinafater more fully explained. The knee portion or tenon 3 is offset rearwardly of the front face of the front wall 2 by a distance substantially equal to the thickness of the front wall 2 by a connector portion or shoulder 4.

The sides of the panel 1 are closed by sidewalls 5 whose upper surfaces match the configuration of the upper edge of the front wall 2 and extend downwardly from the upper edge of the front wall to a point above the bottom of the front wall a distance substantially equal to the height of the tongue or tenon 3 leaving a planar projecting front wall portion 6 adapted to receive the tenon of a lower panel therebehind as shown in the two assembled panels illustrated in FIG. 1.

Figure 4:
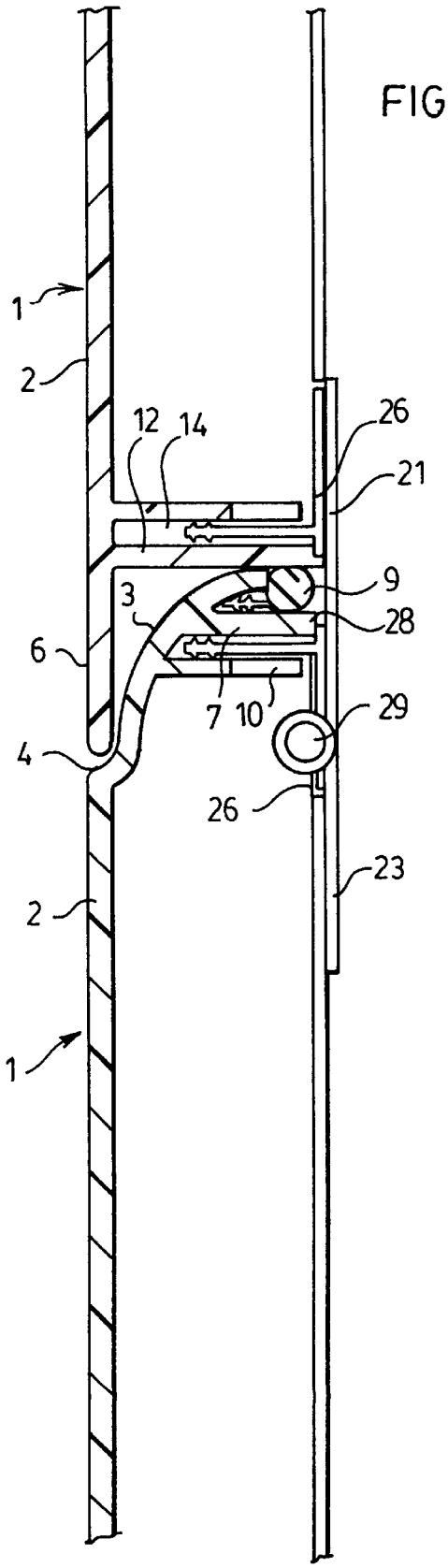
FIG. 4 is a diagrammatic elevational view illustrating the hinging relationship between an upper and lower panel in a closed door situation where the panels are in vertical alignment.
Figure 5:
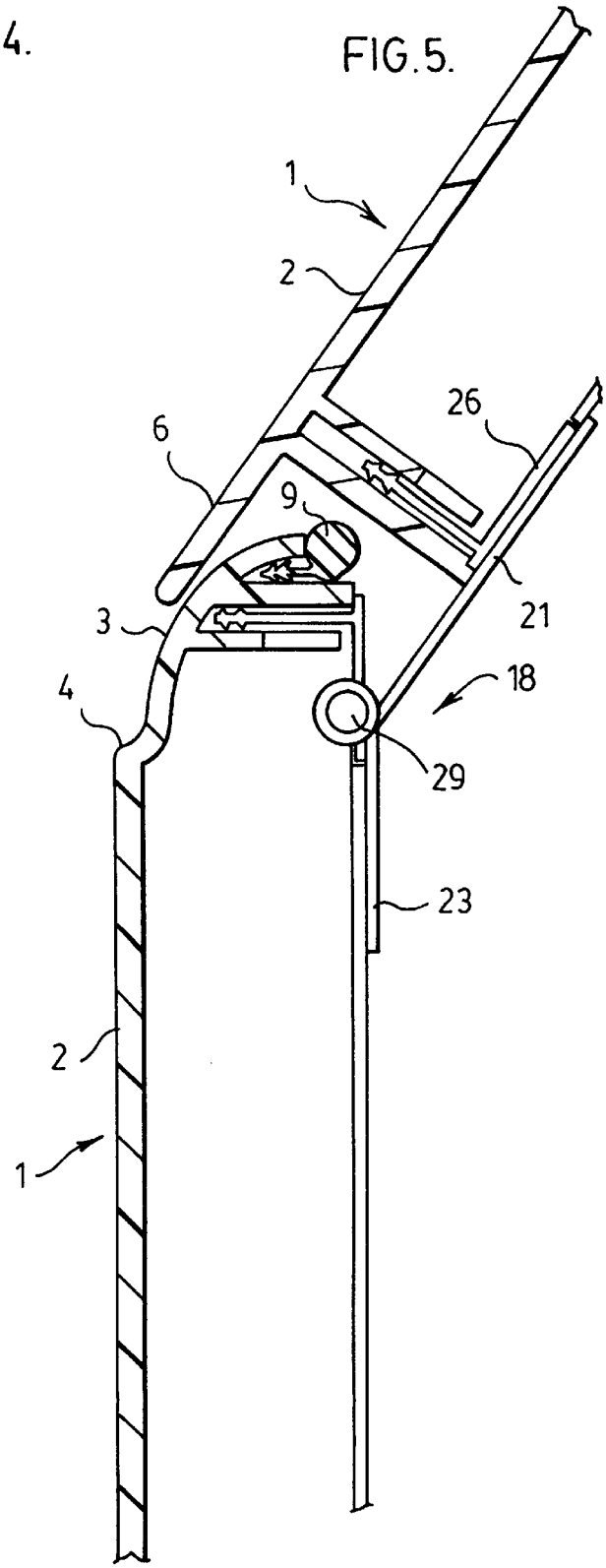
FIG. 5 is a view similar to FIG. 4 but showing the upper panel swung out of its vertical position.

The sidewalls 5 project rearwardly of the tenon 3 and are joined at the top by a first transverse wall 7 to provide a slot 8 in which a compressible sealing member 9 or weather stripping is anchored as shown in FIGS. 4 and 5.

The side walls 5 are connected by a second transverse wall 10 spaced below the first transverse wall 7 to provide a second retaining slot 11 as particularly shown in FIG. 4 for purposes as will hereinafter appear.

As shown in FIG. 2, the lower ends of the side wall are joined by a transverse wall 12 while spaced thereabove is a second transverse wall 13 providing a retaining slot 14 therebetween.

The front wall 2 of the panel 1 is reinforced on its rear side with an integral gridwork 15' of intersecting ribs running diagonally at right angles.

As shown in FIG. 2, extending rearwardly from the rear of the front wall 2 adjacent the sidewall 5 are a series of vertically aligned cylindrical screw receiving pods comprising a pair of hinge, that is hinge strap, locating and mounting top pods 15 and a corresponding pair of hinge strap, locating and mounting bottom pods 16. Intermediate the top and bottom pods 15 and 16 are pods 17.

The opposite side of the panel 1 and the center line of panel 1 have identical pod arrangements and are shown in FIG. 1.

Figure 3:
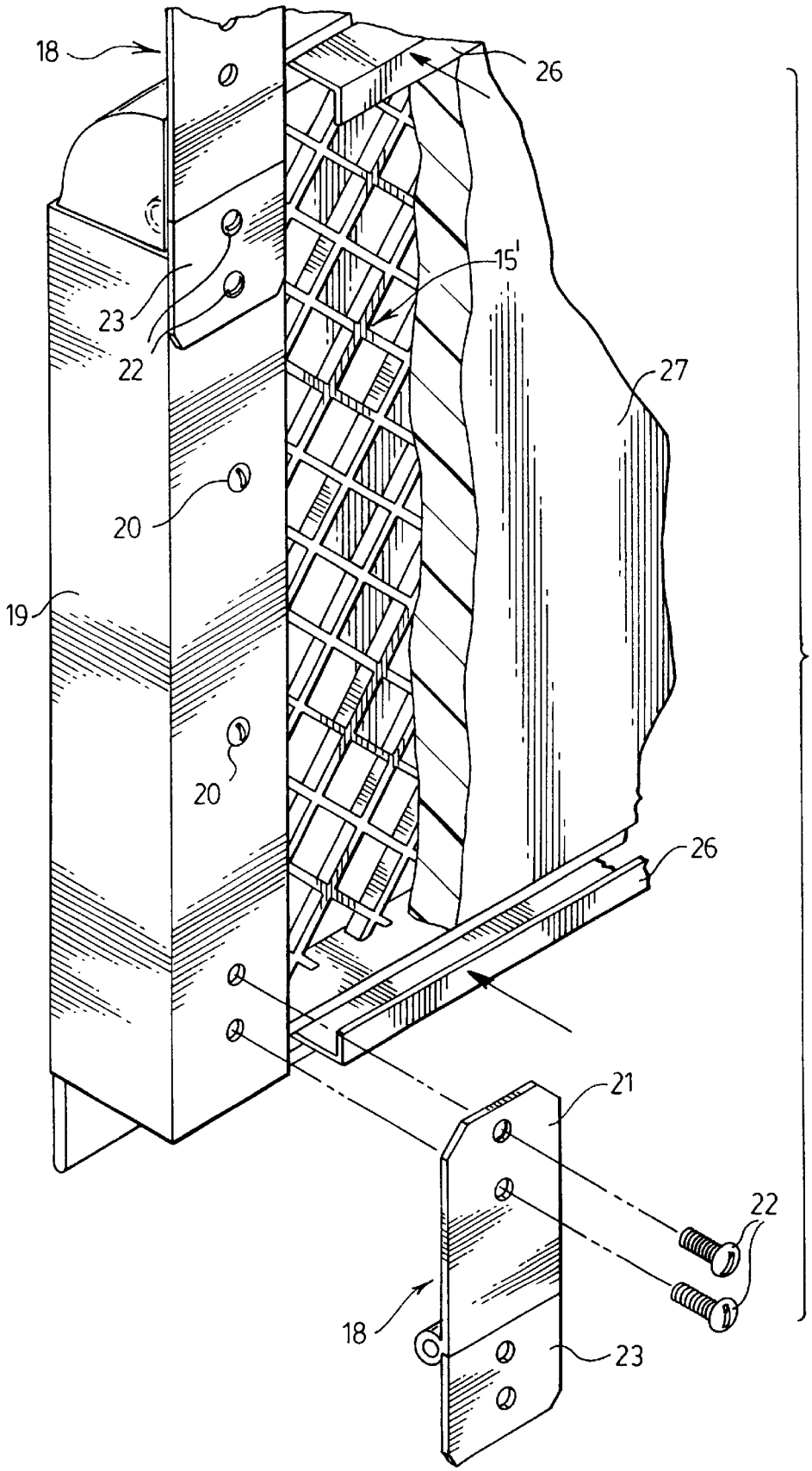
FIG. 3 is a broken away partially exploded perspective view of the rear of the panel of FIG. 2 showing the mounting of the hinges in association with the metal sidewall reinforcement and the provision for rear insulation.

The manner in which the hinges 18 are mounted to hingedly connect adjacent panels is illustrated in FIG. 3.

To provide increased strength the edges of the panels are reinforced with channel members 19, preferably formed of metal, which overlie the arrangement of pods 15, 16 and 17 and are secured by screws 20 which engage in the pods 17. As illustrated in FIG. 3, the upper strap 21 of the lower hinge 18 is about to be secured in position where it overlie the rear of the channel 19 so that the hinge screws 22 will pass threw the upper strap 21 and the channel and engage in the bottom pods 16 of the panel so that the screws 22 serve both to secure the lower hinge 18 and the channel 19 to the panel.

The upper hinge 18 has its lower strap 23 secured in position over the channel 19 by hinge screws 22 which engage in the top pads 15.

As illustrated in FIG. 1, reinforcing metal pieces 24 are adapted to overlie the central arrangement of pods 15, 16 and 17 to add strength and to support hinges 18 for hingedly connecting the central portions of the panels 1.

As above described, the panel 1 is provided with transverse walls 6 and 10 at the top and 12 and 13 at the bottom which not only provide strength to the panel but also provide slots 11 and 14 into which stiffening members such as the stiffening member 25 shown in FIG. 2 may be inserted. Alternatively, the slots 11 and 14 are also adapted to receive angle members 26 as illustrated in FIG. 3 for retaining a layer of insulation material 27.

With reference to FIGS. 4 and 5, it will be seen that the transverse wall 7 which projects beyond the tenon 3 forms an anvil surface 28 for the sealing member 9 against which it is compressed by the bottom wall 12 of an upper panel hingedly connected to the lower panel when the panels are in vertical alignment with the folding door in the closed position. With this arrangement, the ingress or egress of air through the hinged connection is totally blocked.

The pintle or axis 29 of the hinge 18 connecting the upper and lower panels 1 is located at the center of the curvature of the part circular tenon 3 so that as the upper panel pivots relative to the lower panel the bottom portion 6 of the front wall 2 closely follows the surface of the tenon 3 of the lower panel to provide a pinch proof hinge connection while the end channels 19 of the upper panel 1 block entry to the hinging connection from the edges.

Further in this connection, it will be seen from FIG. 4 that the right angularly rearwardly extending transverse wall 12 of the upper panel is spaced above the bottom edge of the front wall portion 6, a distance substantially the same as the height of tenon 3 and projects rearwardly beyond the tenon 3 to overlie the rear of the tenon in close contiguous relation.

With this arrangement as seen in FIG. 5, when the panels are articulated, the transverse wall 12 swings downwardly behind tenon 3 to block finger access to the space between the upper panel wall 6 and lower panel tenon 3 as the bottom edge of wall 6 wipes over the surface of the tenon.

It will be understood that the reinforced edges of the panels reinforced by the channel members 19 provide for the strength of mounting appropriate rollers (not shown) for engaging in trackways to effect the hinging operation when the panels are incorporated into an overhead door during the opening and closing operation of the door.

While the preferred embodiment of the invention has been illustrated, it will be understood that variations may be made without departing from the scope of the appended claims.

The embodiments of the invention in which an exclusive property or privilege is claimed are defined as follows:

1. In an overhead folding garage door incorporating hinged door panels, a first panel forming an upper panel and a second panel forming a lower panel, each said panel being a one piece molded plastic member having a front wall formed with an upwardly and rearwardly arching upper edge forming an upwardly projecting part circular tenon offset rearwardly of the front face of said front wall a distance substantially equal to the thickness of said front wall to define a recessed shoulder, each said panel having side walls extending downwardly from said tenon to a point a distance short of the bottom of said front wall corresponding to the height of said tenon to provide a front wall bottom portion defining a tenon receiving mortis therebehind, said front walls of said panels being reinforced on their rear sides between said side walls with an integral grid work of intersecting ribs, said panels further having on the rear side a hinge locating and mounting arrangement of integral rearwardly projecting pods arranged adjacent the bottom of said upper panel and adjacent the upper edge of said lower panel, said pods having screw receiving bores therein, said panels being connected by a plurality of hinges each having one strap secured by screws driven into the bores of respective ones of said pods on said upper panel and the other strap secured by screws driven into bores of respective ones of said pods on said lower panel, there being metal reinforcements interposed between said hinge straps and said pods, said pods being so arranged that the axes of the pintles of said hinges are located at the center of curvature of said part circular tenon of said lower panel, the arrangement being such that said lower panel is hingedly connected to said upper panel with said lower panel tenon received in said upper panel mortis with the lower edge of said upper panel overlying said recessed shoulder of said lower panel with said panels in vertical alignment whereby on articulation of said panels out of vertical alignment the lower edge of said upper panel closely follows the curved surface of said lower panel tenon.

2. In a garage door as claimed in claim 1 in which each of said panel has a bottom wall joining said side walls and a rearwardly projecting shelf on the underside of said tenon and defining with said tenon a retaining slot, said shelf projecting rearwardly beyond said tenon to provide an anvil surface, and an elongated compression seal is supported on said anvil surface and has a tail secured in said retaining slot, said compression seal being compressed between the bottom wall of said upper panel and said anvil surface of said lower panel upon said panels being articulated into vertical alignment.

3. In a garage door as claimed in claim 2 in which each of said panels has an second shelf below said rearwardly projecting shelf to define therewith a slot to receive a stiffening insert.

4. In a garage door as claimed in claim 3 in which each of said panels has a stiffening member inserted into said insert receiving slot.

5. In a garage door as claimed in claim 4 in which said stiffening member is an angle member having one leg inserted into said insert receiving slot and the other legs projected downwardly from said insert receiving slots.

6. In a garage door as claim in claim 5 in which each of said panels is provided with a second stiffening member receiving slot above said bottom wall, an angle stiffening member having one leg is inserted into said second slot above said bottom wall and the other leg projecting upwardly on a layer of insulating material secured at the rear of said front wall between said downwardly and upwardly projecting legs of said stiffening members.

7. A garage door panel molded from a plastic material, said panel having a front wall having an upper edge portion arched upwardly and rearwardly to form a part circular tenon, said panel having side walls extending down from said tenon, said front wall having an integral reinforcing formation on its rear side between said side walls, said front wall projecting downwardly beyond said side walls a distance substantially equal to the height of said part circular tenon to define a mortis space therebehind, the axial center of said part circular tenon forming a locating axis for pintles of hinges for hingedly connecting said panel to a corresponding panel immediately thereabove in a pivotal tenon and mortis joint, and hinge mounting means for accurately locating the axes of pintles of hinges on the axial center line of said part circular tenon comprising a plurality of integral pods projecting from the rear of said front wall adjacent and below said upper edge and above the lower end of said side walls respectively said pods having screw receiving bores therein to receive screws for fastening the straps of hinges in precisely accurate position to align the axes of pintles of such hinges on said center line.

8. A garage door panel as claimed in claim 7 having a second horizontal shelf below said first horizontal shelf to define a first slot to receive a stiffening member.

9. A garage door panel as claimed in claim 8 having a bottom wall joining said side walls and having a second slot immediately above said bottom wall for receiving a stiffening member.

10. A garage door panel as claimed in claim 9 having said rear side of said front wail covered with a layer of insulating material between said second horizontal shelf and said bottom wall, said material being retained in position by angle members having one leg retained respectively in said first and second slots.

11. A garage door panel as claimed in claim 10 provided with a channel member closing the entrance to said mortis space at each side of said panel.

12. In an overhead folding garage door incorporating hinged door panels, a first panel forming an upper panel and a second panel forming a lower panel, each said panel having an upper edge portion and a lower edge portion, said upper edge portion having a front wall portion and an upwardly and rearwardly arching tenon projecting to a height above and a distance rearwardly of said front wall portion, said tenon being connected to said panel front wall portion and offset rearwardly at said connection a distance substantially equal to the thickness of said front wall portion to define a shoulder at said connection, said lower edge portion having a front wall portion having a bottom edge, and a transverse wall projecting right angularly rearwardly from said lower edge front wall portion, said transverse wall being spaced above said bottom edge a distance substantially equal to the height of said tenon and projecting rearwardly from said lower edge front wall portion a distance at least equal to the distance said tenon projects rearwardly of said upper edge front wall portion, said transverse wall and said lower edge front wall portion defining a tenon receiving mortis behind said lower edge front wall portion, and a plurality of hinges connecting said panels such that said bottom edge of said upper panel seats on said shoulder of said upper edge portion of said lower panel and said transverse wall of said upper panel overlies and is contiguous with the rear most portion of said lower panel tenon with said panels in vertical alignment, and on articulation of said panels out of alignment said bottom edge of said upper panel lower edge portion moves relative to and closely follows the surface of said lower panel arched tenon in a wiping action and said transverse wall of said upper panel moves to block finger access to said wiping action.

13. In an overhead door as claimed in claim 12 in which each of said hinges comprises a pair of straps pivoted about a lunge pintle, one of said straps being secured to the rear of the upper panel and the other of said straps being secured to the rear of the lower panel with said hinge pintle located at the center of curvature of said arched tenon.

14. In an overhead door as claimed in claim 12 or 13 in which said panels are reinforced in their rear sides by a network of intersecting ribs.

15. A panel having an upper edge portion and a lower edge portion, said upper edge portion having a front wall portion and an upwardly and rearwardly arching tenon projecting to a height above and a distance rearwardly of said front wall portion, said tenon being connected to said panel front wall portion and offset rearwardly at said connection a distance substantially equal to the thickness of said front wall portion to define a shoulder at said connection, said lower edge portion having a front wall portion said lower edge front wall portion, said transverse wall being spaced above said bottom edge a distance substantially equal to the height of said tenon and projecting rearwardly from said lower edge front wall portion a distance at least equal to the distance said tenon projects rearwardly of said upper edge front wall portion, said transverse wall and said lower edge front wall portion defining a tenon receiving mortis behind said lower edge front wall portion.

* * * * *